US007871062B1

(12) United States Patent
Montreuil et al.

(10) Patent No.: US 7,871,062 B1
(45) Date of Patent: Jan. 18, 2011

(54) MICROWAVE HUMIDIFIER

(75) Inventors: Michael Montreuil, Brighton, CO (US); Scott Blashaw, Littleton, CO (US)

(73) Assignee: Comfort Specialists, Inc., Denver, CO (US)

( * ) Notice: Subject to any disclaimer, the term of this patent is extended or adjusted under 35 U.S.C. 154(b) by 1086 days.

(21) Appl. No.: 11/605,693

(22) Filed: Nov. 28, 2006

(51) Int. Cl.
*B01F 3/04* (2006.01)

(52) U.S. Cl. ..... 261/129; 261/49; 261/DIG. 15

(58) Field of Classification Search ..... 261/49, 261/129, 130, 131, 139, 142, DIG. 10, DIG. 15, 261/DIG. 76
See application file for complete search history.

(56) References Cited

U.S. PATENT DOCUMENTS 4,711,294 A * 12/1987 Jacobs et al. ..... 165/230
5,290,403 A 3/1994 Saask
5,661,983 A 9/1997 Groten et al.
6,008,482 A * 12/1999 Takahashi et al. ..... 219/687
6,178,762 B1 1/2001 Flax
6,562,113 B1 5/2003 Aykanian et al.
6,673,137 B1 1/2004 Wen
2003/0021595 A1 1/2003 Xu et al.
2005/0006382 A1* 1/2005 Hayakawa et al. ..... 219/682
2005/0072776 A1* 4/2005 Doh et al. ..... 219/682
2005/0087528 A1* 4/2005 Kanzaki et al. ..... 219/682
2006/0269440 A1* 11/2006 Lee et al. ..... 422/4

OTHER PUBLICATIONS

Web page, www.skuttle.com/product.html, "Product List," May 25, 2004.
Web page, content.honeywell.com/yourhome/humidity/steam.htm, "Comfort Products: Humidity Control: Help Me Choose," May 25, 2004.

* cited by examiner

*Primary Examiner*—Scott Bushey
(74) *Attorney, Agent, or Firm*—Marian J. Furst

(57) ABSTRACT

Air humidification system using microwave energy to heat water to produce steam. The system may include an automatic controller.

20 Claims, 5 Drawing Sheets

MICROWAVE HUMIDIFIER

FIELD OF THE INVENTION

The present invention relates generally to an apparatus and method for humidifying air, and more specifically to an apparatus and method that use microwave energy to generate steam for humidifying air.

BACKGROUND OF THE INVENTION

When using a heating system to provide ambient air at a comfortable temperature indoors, it is often desirable to increase the humidity of the heated air. If the air to be heated is initially very cold, such as outdoor air in winter, the heated air will contain very little moisture. Indeed, indoor air may have a humidity, or moisture content, as low as 10 to 15 percent, which is significantly drier than even desert air. Such dry air can cause skin and mucous membranes to dry out, making people uncomfortable and perhaps increasing their susceptibility to infection by air-borne viruses and bacteria. Dry air can also lead to drying of wood structures, such as flooring and furniture, and it can lead to increased static electricity that may damage electronic equipment, such as computers. Thus, indoor air is often humidified, using one of several types of humidification systems that are currently available for residential and commercial use.

In a bypass type of humidification system, air passes over or through a pad or sheet of wet material that has a large surface area. As the air passes the wet surface, it picks up water that evaporates from the surface. Other systems use nozzles to spray small water droplets into the air. If the droplet size is small enough, the droplets evaporate quickly in the air, thereby preventing significant fogging. These types of systems generally require significant maintenance to prevent scale buildup on the pads or sheets or in the nozzles.

Steam humidifiers use heat to boil water in a reservoir or tank, most commonly with a heating coil located inside the tank. This type of humidifier generally uses tap water, which may contain significant quantities of dissolved minerals. As the water in the tank evaporates, the mineral content of the remaining water increases, and eventually minerals precipitate from the water to form scale deposits on the walls of the tank and the heating coil. Over time, the tank volume decreases, and the scale layer on the heating coil acts as a thermal insulator. As a result, the humidifier becomes increasingly inefficient. Although frequently flushing clean water through the tank can slow down the rate of scale buildup, there is no simple way to remove the scale deposits once they form in the tanks and in associated plumbing, and the tanks must be replaced periodically.

Thus, there is a need for a steam humidifier that operates more reliably over long periods of time and that can be easily maintained, rather than routinely replacing major system components, such as holding tanks, heating elements, and solenoid valves.

SUMMARY OF THE INVENTION

In accordance with the purpose of the present invention broadly described herein, one embodiment of this invention comprises an air humidifier system. The system comprises a water reservoir and means for heating water in the reservoir using microwave energy. The reservoir may comprise a cavity that can contain microwave energy therewithin, and the means for heating water may be a magnetron positioned near the reservoir. Alternatively, the means for heating water may comprise a cavity surrounding the water reservoir, with the cavity able to contain microwave energy therewithin. The reservoir may be easily removable from and replaceable into the system, thereby facilitating cleaning.

The air humidifier system also includes means for providing water to the reservoir, means for releasing steam from the reservoir, and means for draining water from the reservoir. The means for providing water may comprise an inlet conduit connected to the reservoir and an inflow control valve for controlling flow of water through the inlet conduit. The means for releasing steam may be a conduit connected to an air duct in a forced air heating system or an air handling mechanism for dispersing steam directly into a room. The means for draining water from the reservoir may comprise an outlet conduit connected to the reservoir and an outflow control valve for controlling flow of water through the outlet conduit. Alternatively, the reservoir may comprises a single water inlet and outlet, and the means for providing water and the means for draining water may comprise a 3-way valve.

Further, the air humidifier system includes means for controlling water flow into and out of the reservoir. The means for controlling water flow may comprise a device responsive to the water level in the reservoir.

The humidifier system also may further comprise means for controlling operation of the system, and the control means may operate automatically. The means for controlling water flow into and out of the system may comprise at least one solenoid valve. The solenoid valve or valves may be in signal communication with the control means, with the control means operative to open and close each of the solenoid valves. In addition, the humidifier system may comprise a humidity sensor and an air proving switch. The system may include an overflow conduit. An overflow alarm may be in signal communication with the control means. In addition, the system may include an overflow drain. The control means may be in signal communication with the means for heating water and the means for water fill, and it may be operative to switch the means for heating water on and off.

BRIEF DESCRIPTION OF THE DRAWINGS

These and other features, aspects, and advantages of the present invention will become better understood with reference to the following description, appended claims, and accompanying drawings, where:

DESCRIPTION OF THE INVENTION

In accordance with the present invention, microwave energy can be used to evaporate water inside a reservoir and supply humidity to air.

Figure 1:
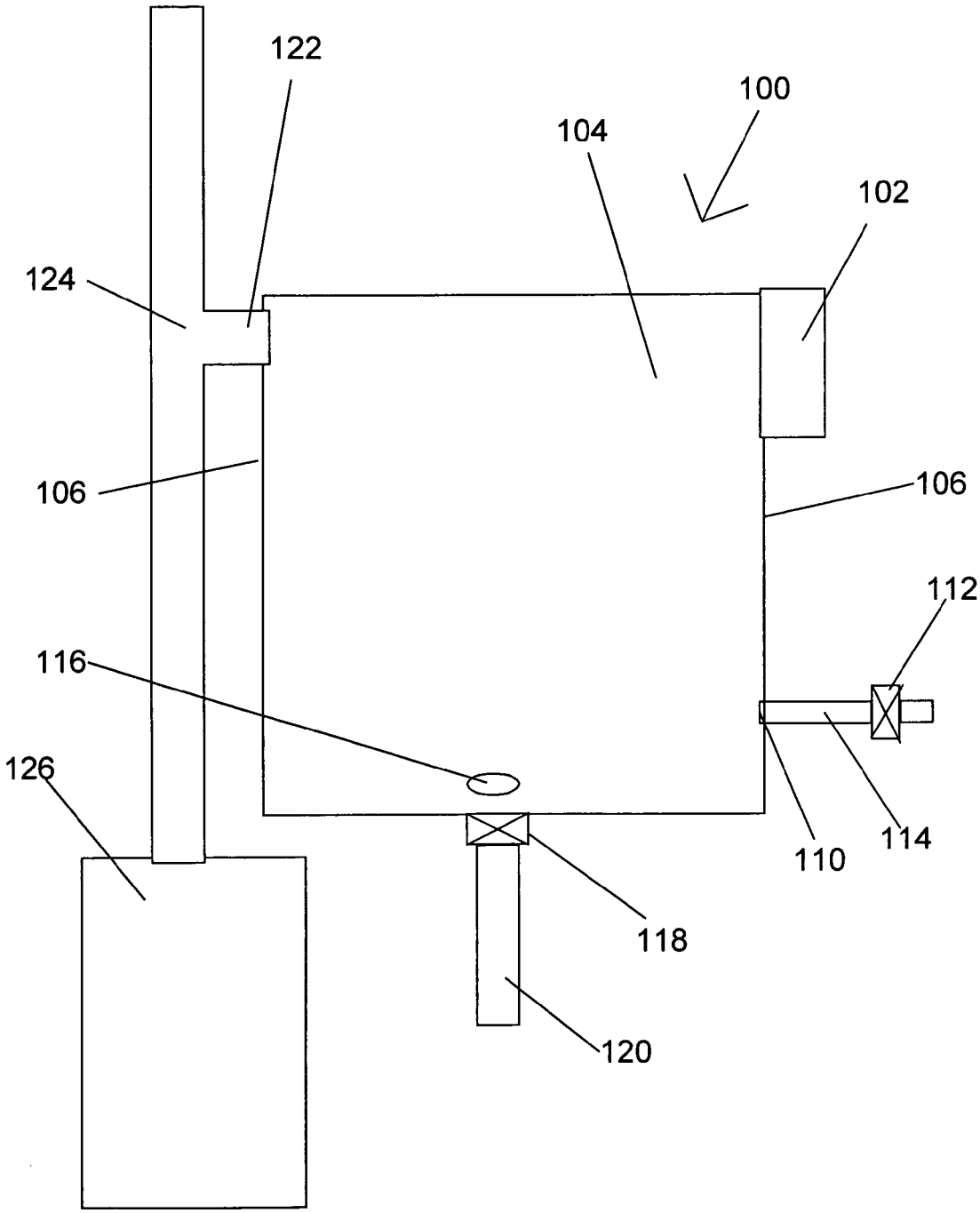
FIG. 1 is a schematic drawing of one embodiment of a humidifier system in accordance with the present invention.
Figure 2:
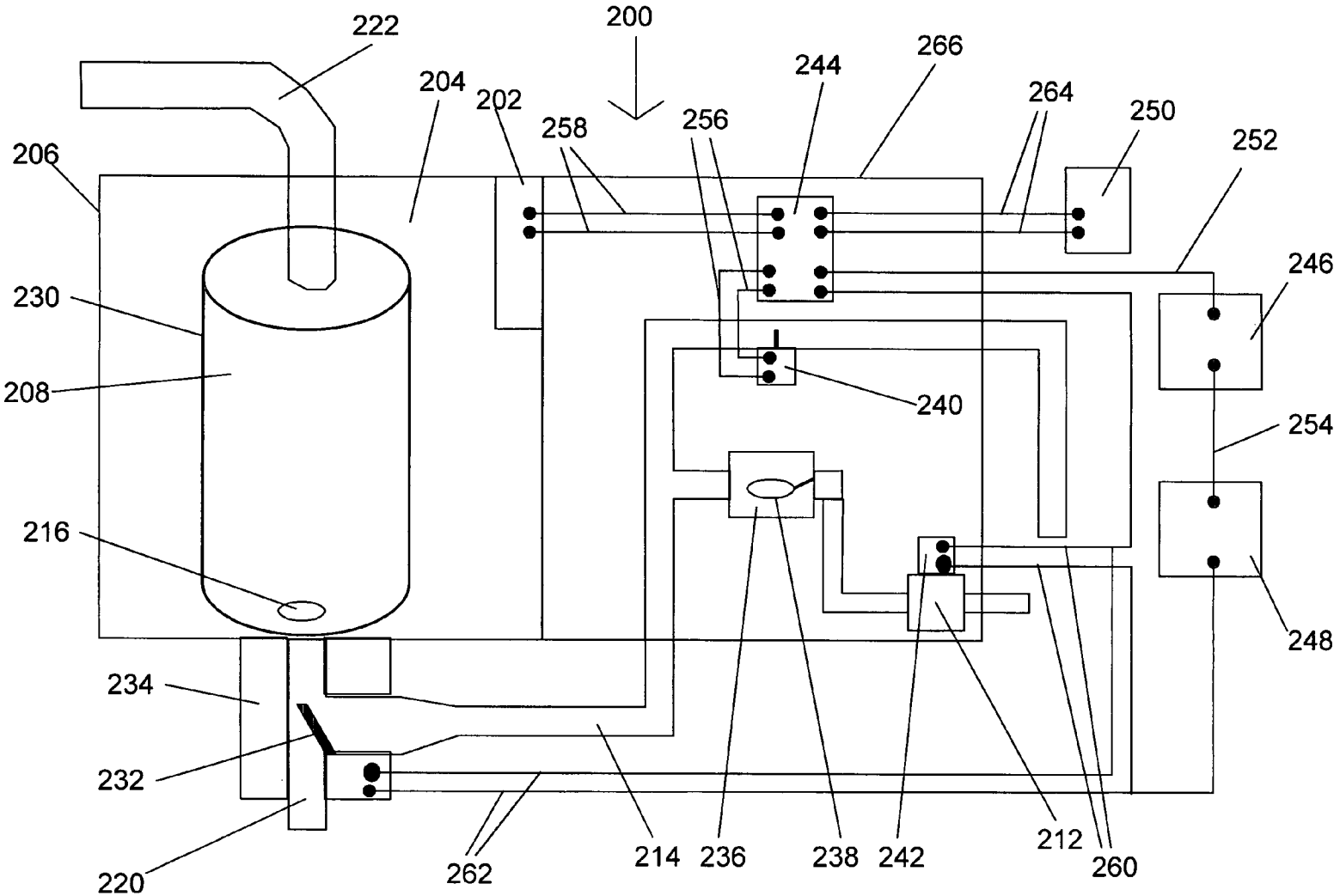
FIG. 2 is a schematic drawing of another embodiment of a humidifier system in accordance with the present invention.

One embodiment of a microwave humidifier system 100 in accordance with the present invention in shown in FIG. 1. A magnetron or other microwave source 102 is adjacent microwave cavity/reservoir 104, similar to a conventional microwave oven. Preferably, cavity/reservoir 104 has walls 106 that are appropriately shielded to prevent leakage of microwaves outside of cavity 104. Cavity/reservoir 104 has a water inlet 110, equipped with inlet valve 112 in inlet conduit 114, and a drain 116, equipped with drain valve 118 in outlet conduit 120. A steam outlet 122 is provided generally near the top of reservoir 108 for escape of steam from the reservoir and into an air duct 124 in a forced air heating system, delivering air from furnace 126 to a room. Alternatively, the steam can be released directly into a room. If the steam is released directly into a room, it is desirable to use a fan or other air handling mechanism (not shown) to disperse the steam.

In use, initially, water outlet valve 118 is closed, and water inlet valve 112 is then opened to supply water to cavity/reservoir 104. When reservoir 104 is filled with water to a desired level, inlet valve 112 is closed. Microwave energy is supplied by source 102 to heat the water in the reservoir 104 sufficiently to provide steam, which exits the reservoir via steam outlet 122, either into the air duct 124 of a heating system, or directly into a room which is to be humidified (not shown). The microwave source 102 may be turned off when the desired humidity level is reached and restarted when the humidity drops below a desired level. When the water level in reservoir 104 becomes low, the inlet valve 112 may be opened to refill reservoir 104. If it is desired to drain the reservoir 108, drain valve 118 is opened.

Preferably, at least periodically during the operation of the humidifier, mineral-rich water is drained from cavity/reservoir 104, and the reservoir is flushed by refilling it with water and subsequently draining it again. The flushing operation may be conducted by successively closing drain valve 118, opening inlet valve 112, allowing the reservoir 104 to fill, closing inlet valve 112, and opening drain valve 118. After the reservoir is flushed, drain valve 118 is closed, and inlet valve 112 is opened to refill the reservoir.

It is desirable to include a control system for a humidifier in accordance with the present invention, so that the humidifier operates with minimal human involvement. Preferably, the system is designed to receive and operate with standard 110V power, which is advantageous when compared with steam humidifiers currently in use that operate with 220V power.

FIGS. 2-5 show another embodiment 200 of a humidifier that includes one such control system. Reservoir 208 is formed from plastic or another microwave-transparent material and is positioned within a microwave cavity 204 having suitable shielding 206. A microwave source 202 is positioned to transmit microwaves into cavity 204. At the top of reservoir 208 is a steam outlet 222. It should be noted that the steam outlet could also be positioned on the side wall 230 of reservoir 208, above the maximum liquid water level expected in reservoir 208. At or near the bottom of reservoir 208 is an electrically activated 3-way fill/drain valve 232, leading to drain conduit 220 and inlet conduit 214. A 3-way drain solenoid 234 operates fill/drain valve 232. Inlet conduit 214 is in fluid communication with chamber 236 and reservoir 208 via fill solenoid 242 and fill valve 212, float valve 238 in chamber 236, and 3-way drain/fill valve 232. A branch from inlet conduit 214 extends above the height of float valve 238 and past an overflow alarm 240 to a drain outlet 216. Overflow alarm 240 includes an overflow sensor at least partly within the branch of conduit 214.

System 200 is controlled by controller 244, which is in electrical contact with a humidistat 246, an air proving switch 248, overflow alarm 240, microwave source 202, fill solenoid 242, 3-way solenoid 234, and a 110 V power source 250 via electrical lines 252, 254, 256, 258, 260, 262, and 264, respectively. As shown, controller 244 and a portion of the inlet system are enclosed in a housing 266, which provides protection for the system components and may make the system more attractive. However, the housing 266 does not affect the functions of system 200, and the system would operate without it. Also, overflow alarm 240 may only provide an audible or visible alarm signal indicating that the system needs attention, although it is preferable that the alarm 240 is in communication with the controller 244, as shown.

Figure 3:
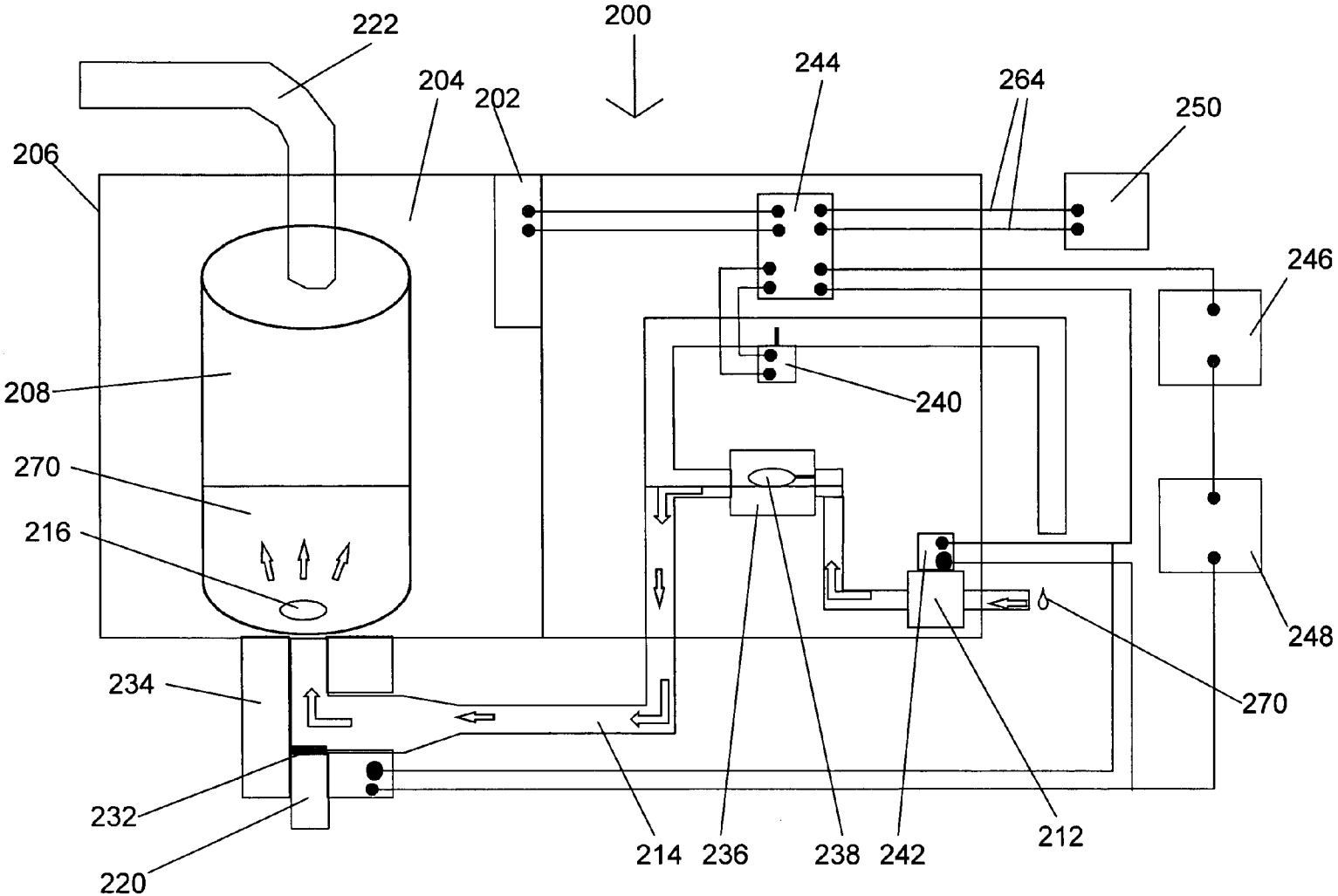
FIG. 3 is a schematic drawing showing water filling of the embodiment of FIG. 2.
Figure 4:
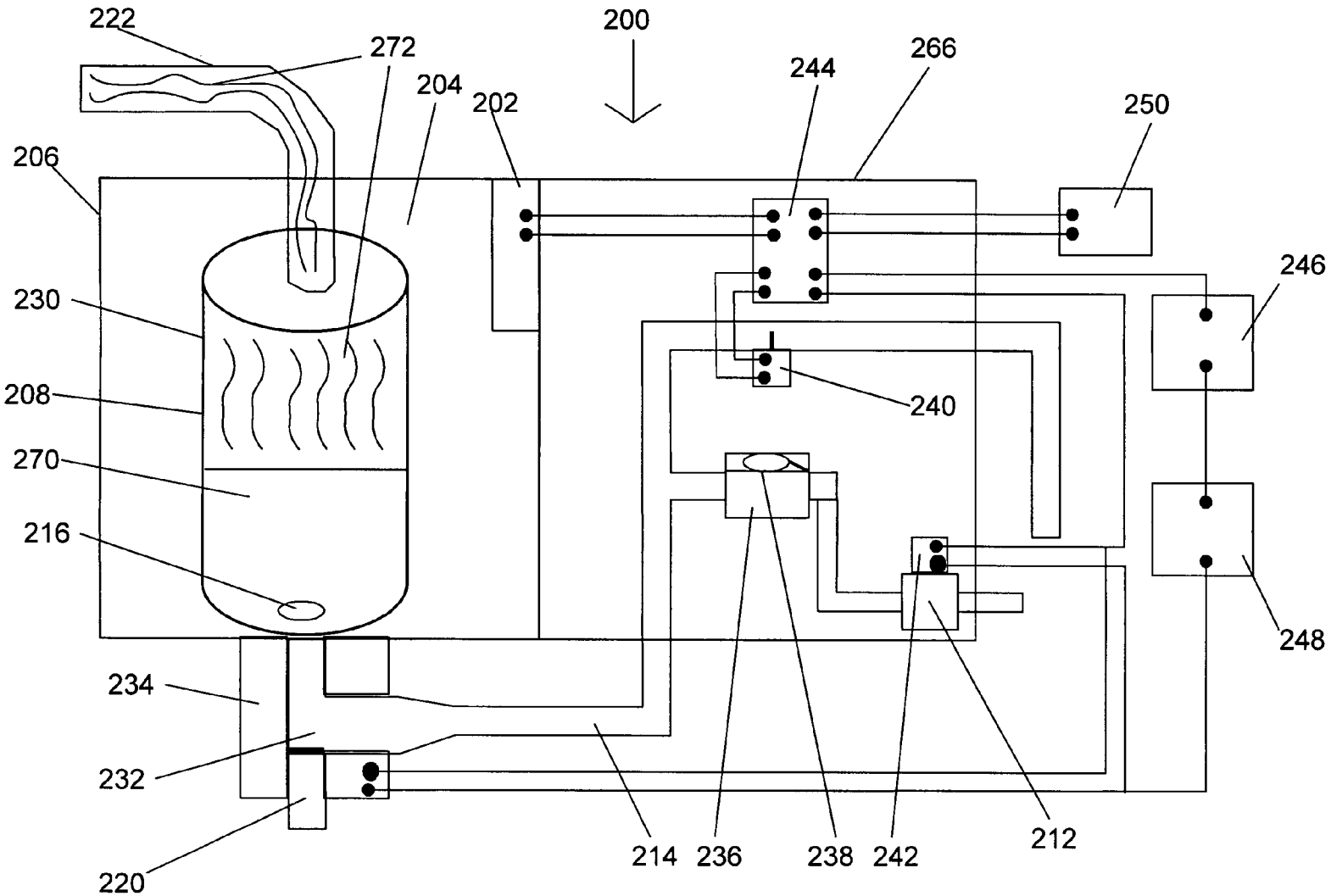
FIG. 4 is a schematic drawing showing operation of the embodiment of FIG. 2 to provide humidity.
Figure 5:
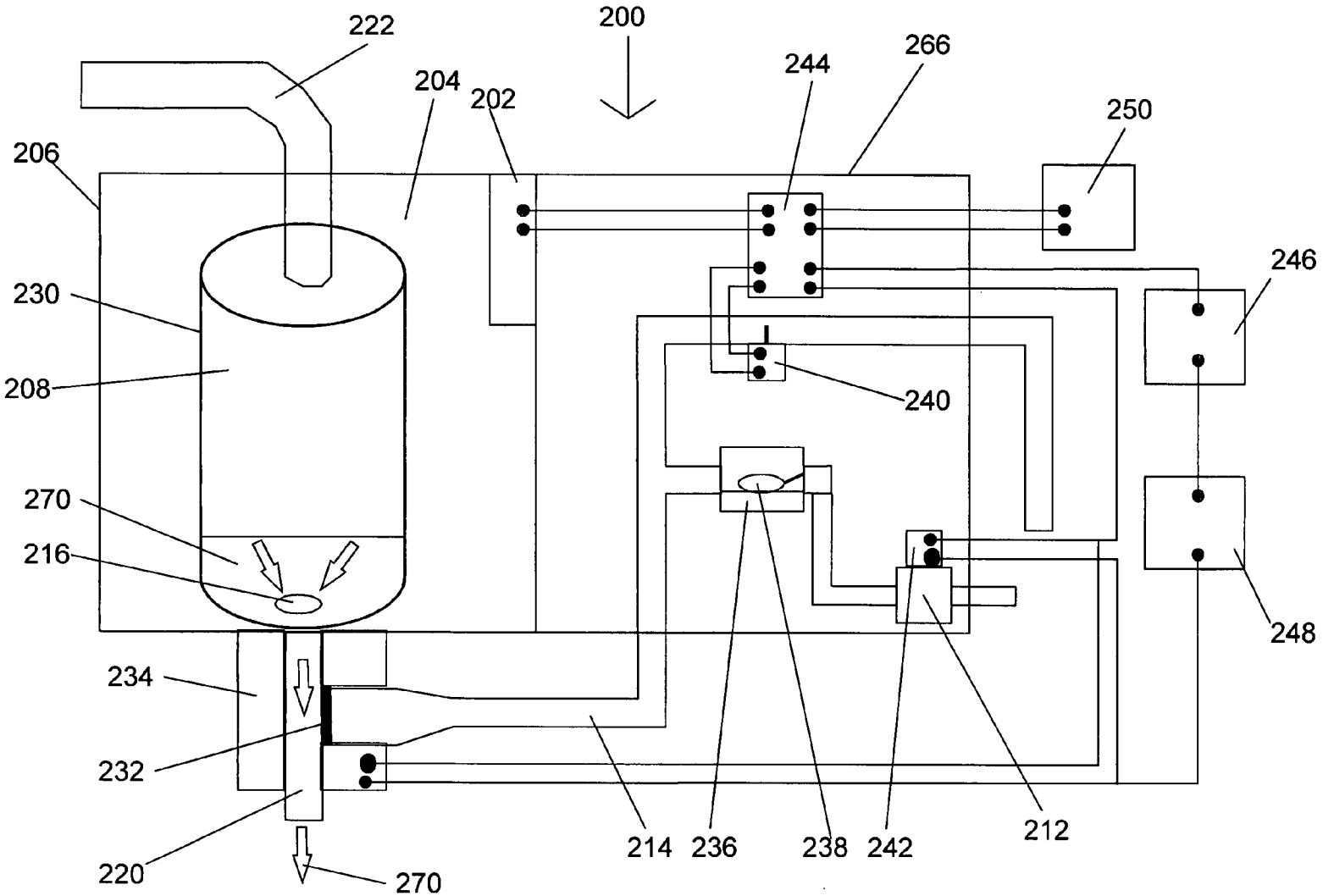
FIG. 5 is a schematic drawing showing flushing of the embodiment of FIG. 2.

The operation of humidifier system 200 can be understood with reference to FIGS. 3-5. Once the system is connected via lines 264 to a source of electricity, such as a standard 110 volt line, and microwave source 202 is enabled, controller 244 receives a signal from humidistat 246 indicating the humidity of the room air is too low. If air proving switch 248 indicates that the blower fan is operating and the humidistat 246 signals that more humidity is required, controller 244 sends a signal to fill solenoid 242 to open fill valve 212 and another signal to 3-way solenoid 234 to position 3-way valve 232 such that water can flow into reservoir 208 and not through drain conduit 220, thus allowing water 270 to flow through inlet conduit 214 past float valve 238 and into reservoir 208, as indicated by the arrows in FIG. 3. When reservoir 208 is filled to a sufficiently high level, float valve 238 shuts off the flow of water through conduit 214.

Referring to FIG. 4, controller 244 then sends a signal to microwave source 202 to generate microwaves for transmission into cavity 204 to heat the water in reservoir 208, rapidly creating steam. The steam 272 escapes through steam outlet for release into an air duct or directly into a room. As the water evaporates in reservoir 208, the water level decreases, and float valve 238 allows additional water to flow through inlet conduit 214 and into reservoir 208. If the humidistat still indicates that the humidity is too low, the cycle continues. If the humidistat 246 indicates that the humidity level is acceptable, the controller 244 shuts off power to the system 200, except that the microwave source 202 remains enabled. The system 200 is ready to repeat the cycle as needed when the humidity drops below an acceptable level. It should be noted that air proving switch 248 prevents the system from providing steam when the heating system fan is not operating, thereby preventing water from condensing and accumulating in the air ducts. An accumulation of water in the ducts may cause the ducts to rust.

If the water level reaches a level higher than the upper level allowed by float valve 238, overflow alarm 240 is triggered and provides an alarm signal to controller 244, which then closes inlet valve 212 via fill solenoid 242. Alarm 240 preferably also provides an audible or visible signal that the system needs attention due to an overflow. Alternatively, the audible or visible alarm could alert a person to shut the system down manually.

The humidifier system plumbing, including inlet conduit 214, reservoir 208, and drain conduit 220, may be flushed to prevent accumulation of scale inside the reservoir and conduits. Preferably, the system is flushed at selected time intervals, such as every twenty-four hours. Alternatively, the system could be flushed after a pre-selected number of cycles, but this is less desirable because the system might run continuously under some circumstances, such as in a large building, The flushing process can be understood with reference to FIG. 5. After a predetermined period of operation, Controller 244 sends a signal to 3-way solenoid 234 to position 3-way valve 232 so as to open drain conduit 216 and close inlet conduit 214, thus allowing mineral-rich water to drain from reservoir 208. After a predetermined amount of time that is sufficient for reservoir 208 to drain completely, 3-way valve opens the inlet conduit 214 and closes drain conduit 220, and reservoir 208 is refilled with water.

Preferably, the water reservoir in accordance with the present invention is easily removed from the system for cleaning and removal of any scale that accumulates inside reservoir. Also preferably, the reservoir is easily replaceable if it is damaged or, possibly, if it is desired to use a different size reservoir. The humidifier of the present invention can be installed with a new forced air heating system, or it can be added onto an existing forced air heating system with only minor modifications to the heating system, such as providing a connection between the steam outlet and an air duct.

As illustrated in FIGS. 2-5, a controller suitable for use in accordance with the present invention may operate via electrical connections between all of the system components it controls. Alternatively, one or more of the electrical connections could be replaced by another communication method known in the art, including but not limited to sound, radio frequency, or visible light waves transmitted and received between the system components.

The foregoing description is considered as illustrative only of the principles of the invention. Further, since numerous modifications and changes will readily occur to those skilled in the art, it is not desired to limit the invention to the exact construction and process shown and described above. Accordingly, all suitable modifications and equivalents may be resorted to falling within the scope of the invention.

What is claimed is:

1. An air humidifier system, comprising:

a water reservoir;

means for heating water in said reservoir using microwave energy;

means for providing water to said reservoir;

means for releasing steam from said reservoir;

means for draining water from said reservoir; and means for controlling water flow into and out of said reservoir, wherein said means for controlling is cooperable with at least one component selected from the group consisting of: 1) a humidity sensor and an air proving switch; 2) an overflow conduit with an overflow alarm; and 3) said means for providing water and said means for draining water comprise a 3-way valve and a single water inlet and outlet to said reservoir.

2. The humidifier system of claim 1, wherein said means for heating water is a magnetron positioned near said reservoir.

3. The humidifier system of claim 1, wherein said means for providing water comprises an inlet conduit connected to said reservoir and an inflow control valve for controlling flow of water through said inlet conduit.

4. The humidifier system of claim 1, wherein said means for releasing steam is selected from a conduit connected to an air duct in a forced air heating system and an air handling mechanism for dispersing steam directly into a room.

5. The humidifier system of claim 1, wherein said means for draining water from said reservoir comprises an outlet conduit connected to said reservoir and an outflow control valve for controlling flow of water through said outlet conduit.

6. The humidifier system of claim 1, wherein said means for controlling water flow comprises a device responsive to the water level in said reservoir.

7. The humidifier system of claim 1, further comprising means for controlling operation of said system.

8. The humidifier system of claim 1, wherein said means for controlling water flow into and out of said reservoir comprises at least one solenoid valve.

9. The humidifier system of claim 8, wherein said solenoid valve or valves are in signal communication with said control means, and said control means is operative to open and close each of said solenoid valves.

10. The humidifier system of claim 1, comprising a humidity sensor and an air proving switch.

11. The humidifier system of claim 1, wherein said control means operates automatically.

12. The humidifier system of claim 1, further comprising an overflow conduit.

13. The humidifier system of claim 12, comprising an overflow alarm.

14. The humidifier system of claim 13, wherein said overflow alarm is in signal communication with said control means.

15. The humidifier system of claim 12, further comprising an overflow drain.

16. The humidifier system of claim 1, wherein said reservoir is easily removable from and replaceable into said system.

17. The humidifier system of claim 7, wherein said control means is in signal communication with said means for heating water and is operative to switch said means for heating water on and off.

18. The humidifier system of claim 1, wherein said means for heating water comprises a cavity surrounding said water reservoir, and wherein said cavity can contain microwave energy therewithin.

19. The humidifier system of claim 1, wherein said reservoir comprises a cavity that can contain microwave energy therewithin.

20. The humidifier system of claim 1, wherein said means for providing water and said means for draining water comprise a 3-way valve and a single water inlet and outlet to said reservoir.

* * * * *